US008734137B2

(12) United States Patent
Goodwin

(10) Patent No.: US 8,734,137 B2
(45) Date of Patent: May 27, 2014

(54) FLUID DISPENSER COMPRISING A BELLOWS

(75) Inventor: David Malcolm Goodwin, Pyrford (GB)

(73) Assignee: R. J. Doran Co. Ltd., Kent (GB)

( * ) Notice: Subject to any disclaimer, the term of this patent is extended or adjusted under 35 U.S.C. 154(b) by 1290 days.

(21) Appl. No.: 11/988,788

(22) PCT Filed: Jul. 14, 2006

(86) PCT No.: PCT/GB2006/002625
§ 371 (c)(1),
(2), (4) Date: Jan. 14, 2008

(87) PCT Pub. No.: WO2007/010214
PCT Pub. Date: Jan. 25, 2007

(65) Prior Publication Data

US 2009/0136370 A1 May 28, 2009

(30) Foreign Application Priority Data

Jul. 15, 2005 (GB) ..... 0514584.2

(51) Int. Cl.
*F04B 45/02* (2006.01)

(52) U.S. Cl.
USPC ..... 417/472

(58) Field of Classification Search
USPC ..... 417/472, 473; 222/321.6, 321.8, 321.9, 222/341, 378, 92, 96, 97, 106, 212, 213, 222/323, 241; 137/628, 630.14
See application file for complete search history.

(56) References Cited

U.S. PATENT DOCUMENTS

| | | | | | |
|---|---|---|---|---|---|
| 182,298 | A | * | 9/1876 | Bangs | 417/472 |
| 1,330,919 | A | * | 2/1920 | Snell | 123/179.1 |
| 2,180,818 | A | * | 11/1939 | Fields et al. | 417/471 |
| 2,663,363 | A | * | 12/1953 | Krautter et al. | 431/38 |
| 2,809,868 | A | * | 10/1957 | Thompson | 239/93 |
| 2,899,110 | A | | 8/1959 | Parker | |
| 3,730,180 | A | * | 5/1973 | Davison | 128/204.24 |
| 4,147,476 | A | | 4/1979 | Warren | |
| 4,519,422 | A | * | 5/1985 | Cohen | 137/630.14 |

(Continued)

FOREIGN PATENT DOCUMENTS

| | | |
|---|---|---|
| FR | 2461530 | 2/1981 |
| JP | 62 282663 | 12/1987 |

(Continued)

OTHER PUBLICATIONS

Wikipedia, Sylphon, http://en.wikipedia.org/wiki/Sylphon (optional description here) (as of Oct. 20, 2011, 10:29 GMT).*

*Primary Examiner* — Charles Freay
*Assistant Examiner* — Philip Stimpert
(74) *Attorney, Agent, or Firm* — Iandiorio Teska & Coleman LLP

(57) ABSTRACT

Apparatus for introducing a liquid into a sealed external container or a sealed external system, the apparatus having a bellows which is sealed a first end, which is sealed at a second end solely by a valve, and which contains the liquid; wherein the valve is one which is positioned remote from the first end of the bellows, which retains the liquid in the bellows, and which permits liquid flow only in a direction from the apparatus to the sealed external container or the sealed external system; and wherein the apparatus further has a connector which in use forms a sealed connection between the apparatus and a sealing valve on the sealed external container or the sealed external system.

21 Claims, 15 Drawing Sheets

(56) References Cited

U.S. PATENT DOCUMENTS

| | | | | |
|---|---|---|---|---|
| 5,186,563 | A * | 2/1993 | Gebhard et al. | 401/153 |
| 5,205,441 | A * | 4/1993 | Andris | 222/207 |
| 5,553,745 | A * | 9/1996 | McMillian | 222/92 |
| 5,979,711 | A * | 11/1999 | Fuchs et al. | 222/321.2 |
| 6,062,437 | A * | 5/2000 | Mascitelli | 222/212 |
| 6,073,814 | A * | 6/2000 | Fuchs | 222/321.1 |
| 6,209,760 | B1 * | 4/2001 | Fuchs | 222/321.6 |
| 6,755,327 | B1 | 6/2004 | Hazard et al. | |
| 6,789,702 | B2 * | 9/2004 | O'Connor et al. | 222/96 |
| 2004/0265149 | A1 * | 12/2004 | Harigaya et al. | 417/412 |
| 2004/0265157 | A1 | 12/2004 | Fuchs | |

FOREIGN PATENT DOCUMENTS

| | | |
|---|---|---|
| JP | 09 267855 | 10/1997 |
| WO | WO 90/03849 | 4/1990 |
| WO | WO 92/22495 | 12/1992 |
| WO | WO 96/11065 | 4/1996 |

* cited by examiner 74
78
80
86
88
82
84
76
68

90
94
92
68

96
100
102
104
98

70
72
68

64
66
68

FLUID DISPENSER COMPRISING A BELLOWS

FIELD OF THE INVENTION

This invention relates to apparatus for introducing a fluid into a sealed container or system.

DESCRIPTION OF RELATED ART

There are often occasions where it is necessary to introduce a fluid into a container or system. Known apparatus for doing this is disclosed in U.S. Pat. Nos. 2,809,868 and 5,205,441, and USA published Patent Application No. 2004/02654119.

BRIEF SUMMARY OF THE INVENTION

It is an aim of the present invention to provide apparatus for use in the above mentioned occasions.

Accordingly, the present invention provides an apparatus for introducing a fluid into a sealed external container or a sealed external system, wherein the apparatus comprises a bellows which is sealed at a first end, which is sealed at a second end solely by valve means, and which contains the fluid; wherein the valve means is one which is positioned remote from the sealed end of the bellows, which retains the fluid in the bellows, and which permits fluid flow only in a direction from the apparatus to the sealed external container or the sealed external system; wherein said apparatus further comprises connector means which in use forms a sealed connection between the apparatus and a sealing valve on the sealed external container or the sealed external system; wherein the bellows contains the liquid prior to connection to the sealed external container or the sealed external system; and wherein the sealed external container or the sealed external system is constructed to be operable independently of the bellows.

The apparatus may be used to top-up a container or system already containing fluid, or the apparatus may be used to fill a previously empty container or system. Fluid dispensed into a container or system may be the same as the fluid already in the container or system or it may be different from the fluid in the container or system. By way of example, it is mentioned that a different fluid may be injected into a closed system for air conditioning or refrigeration in order to indicate if there are leaks in the system, the injected fluid being of a type which is easily noticeable if it leaks from the system. Generally, the apparatus may be used with the system under pressure, in a vacuum, or at ambient pressure.

The fluid may be any suitable and appropriate type of fluid. Thus the fluid may be a liquid, a gas, or a mixture of liquid and gas. Any suitable and appropriate type of liquid may be employed. Any suitable and appropriate type of gas may be employed.

The bellows may be made of a metal. Any suitable and appropriate metal may be employed.

The bellows may alternatively be made of a plastics material. Any suitable and appropriate plastics material may be employed.

The bellows may have side walls which in longitudinal section have a wave form which has curved peaks and troughs. If the bellows is made of a metal, then this type of wave form will enable the bellows to be resilient so that the bellows can be compressed and then the bellows will resume its normal shape once the compressing pressure or vacuum is removed from the bellows. If the bellows is made of a plastics material, then the bellows will also be resilient.

Alternatively, the bellows may have side walls which in longitudinal section have a wave form which has pointed peaks and troughs. With such pointed peaks and troughs, if the bellows is made of a metal, then the bellows will not be resilient and it will be permanently deformable. Such an action may be desirable for single-shot dispensing apparatus. If the bellows is made of a plastics material, then the bellows will normally be resilient with the peak and trough side wall formation.

The apparatus may be one in which the valve means is operated by movement of the bellows.

The valve means may be a stem valve which is partially positioned in the bellows. Alternatively, the valve means may be positioned at an opposite end of the bellows to the said sealed one end. Alternatively, the valve means may be positioned remote from the bellows. Where the valve means is positioned remote from the bellows, the valve means may be a spring biased valve which is biased by a spring.

Alternatively, the apparatus may be one in which the valve means is separate from the bellows and is operated independently of the bellows.

The connector means for connecting the apparatus to an external container or system enables the apparatus to be used to dispense fluid into the external container or system, or to remove fluid from the external container or system.

The connector means may comprise a conduit having a first end which is connected to the remainder of the apparatus, and a second end which is provided with a connector for connecting to the external container or system. The connector means may be a mechanical connector means such for example as a screw clamp, or the connector means may be an adhesive.

The connector at the second end of the conduit may be a screw connector. Other types of connector may be employed.

The first end of the conduit may be connected to the remainder of the apparatus by a screw connector. Other means for connecting the first end of the conduit to the remainder of the apparatus may be employed. Thus the first end of the conduit may be a permanent connection to the remainder of the apparatus, or it may be a removable connection to the remainder of the apparatus.

The valve means may be operated by movement of the bellows. Where the valve means is separate from the bellows and is operated independently of the bellows, then the valve means may be provided in the conduit means. The valve means may thus be a valve such for example as a one-way valve.

The apparatus will normally be one in which the bellows includes an aperture through which the fluid flows.

The apparatus of the present invention may include filler means for filling a part of the bellows from which the fluid cannot be obtained during use of the apparatus. This part of the bellows will usually be at the end of the bellows farthest from the above mentioned aperture. This part of the apparatus may be regarded as a dead space within the bellows.

The filler means may be a formation on part of the bellows which extends inwardly of the bellows and into the part of the bellows from which the fluid cannot be obtained during use of the apparatus. The formation is preferably a hollow formation but it may be a solid formation.

Alternatively, the filler means may be an insert in the inside of the bellows.

The insert may be a plug which is secured in position to the inside of the bellows.

Alternatively, the insert may be a one-piece insert. In this case, the apparatus may be one in which the one-piece insert is a non-compressible one-piece insert, in which the aperture in the bellows is large enough to receive the one-piece insert, and in which the aperture is reduced in size by a reducer device having a smaller aperture than the aperture in the bellows.

Alternatively, the one-piece insert may be a compressible insert which is able to be compressed to pass through the aperture in the bellows and which then expands to stay inside the bellows.

Alternatively, the insert may be a multi-piece insert formed of separate pieces. In this case, the apparatus may include retainer means for retaining the separate pieces of the multi-piece insert in the bellows.

BRIEF DESCRIPTION OF THE SEVERAL VIEWS OF THE DRAWINGS

Embodiments of the invention will now be described solely by way of example and with reference to the accompanying drawings in which.

DETAILED DESCRIPTION OF THE DRAWINGS

Figure 2:
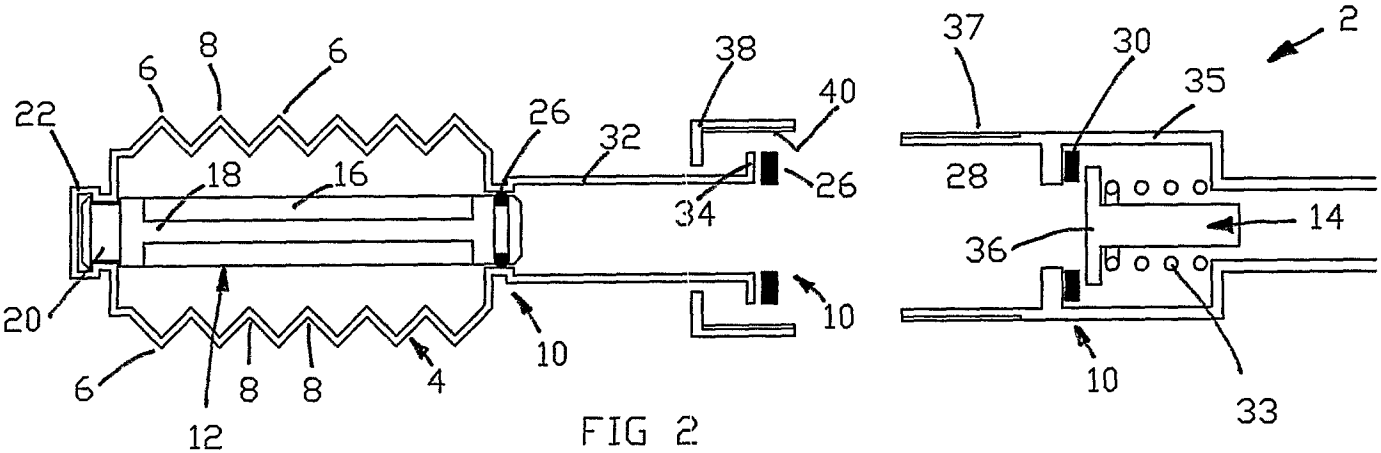
FIG. 2 is an exploded view of the apparatus as shown in FIG. 1.
Figure 1:
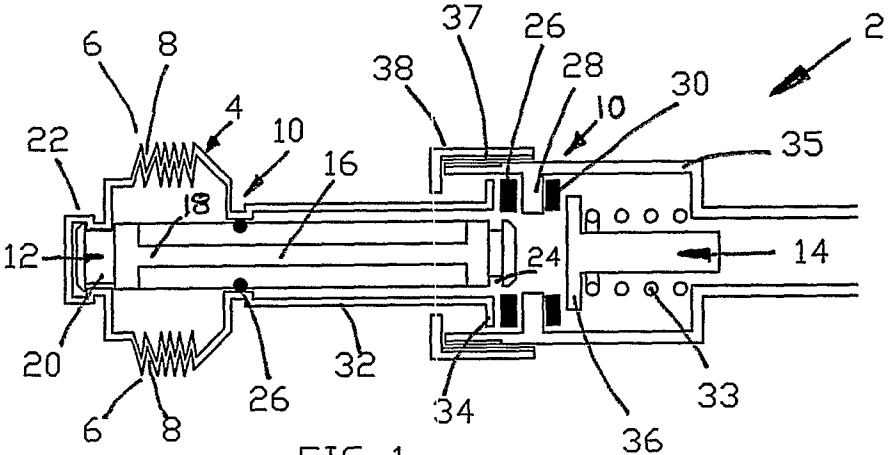
FIG. 1 is a longitudinal section through first apparatus of the invention.

Referring to FIGS. 1 and 2, there is shown apparatus 2 for introducing a fluid into an external container or system. The apparatus 2 comprises a bellows 4. The bellows 4 may be made of a metal or a plastics material. The bellows 4 has side walls which in longitudinal section have a wave form which has pointed peaks 6 and troughs 8.

The apparatus 2 includes valve means 10 which retains the fluid in the bellows 4, and which permits fluid flow in a direction from the apparatus 2 to the external container or system. As can be seen, the valve means 10 may include a first valve means comprising a valve stem 12 and a second valve means comprising a one-way valve 14.

The stem valve 12 comprises a valve stem 16 which has longitudinally extending fins 18 as shown. The valve stem 16 has a holding formation 20 at one end which locates in a complementary formation 22 in the bellows 4. By this means, the valve stem 16 is secured to the bellows 4. The other end of the valve stem 16 has a groove 24 which receives an O-ring seal 26. As can be seen from FIG. 2, when the apparatus 2 is not in use and the bellows 4 is not compressed, then the valve stem 16 is substantially entirely positioned in the bellows 4. When the bellows 4 is compressed as shown in FIG. 1, then the valve stem 16 extends substantially through the bellows 4.

The one-way valve 14 comprises a seal 26 which locates on one side of an abutment 28, and a seal 30 which locates on the other side of the abutment 28. An extension part 32 of the bellows 4 has a flange 34 which presses the seal 26 against the abutment 28. The valve member 36 is spring-biased by a spring 33 into contact with the seal 30. The one-way valve 14 is provided in a valve housing 35 having a screw-threaded portion 37 which receives a nut 38 having a screw-threaded portion 40.

Figure 3:
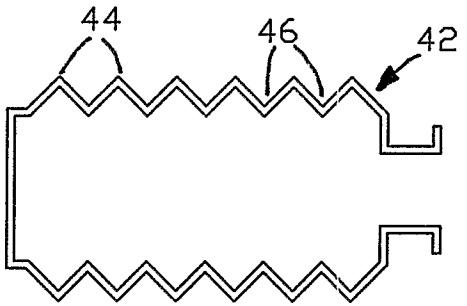
FIG. 3 shows a bellows with side walls having one type of configuration.

Referring now to FIG. 3, there is shown a bellows 42 which may be made of a metal or a plastics material, and which has side walls which in longitudinal section have a waveform having pointed peaks 44 and pointed troughs 46.

Figure 4:
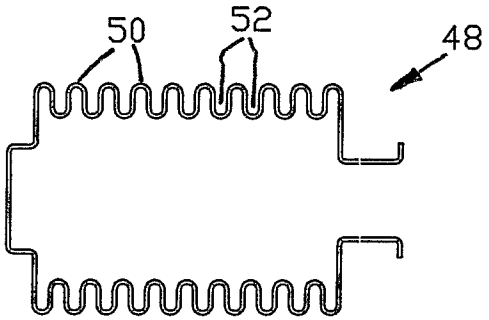
FIG. 4 shows a bellows with side walls having another type of configuration.

FIG. 4 shows a bellows 48 which may be made of a metal or a plastics material. The bellows 48 has side walls which in longitudinal section have a wave form having curved peaks 50 and curved troughs 52.

Figure 5:
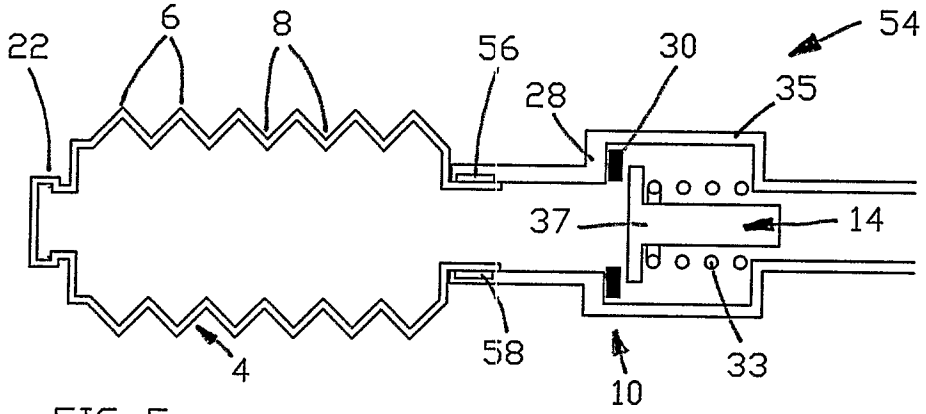
FIG. 5 shows second apparatus of the invention.
Figure 6:
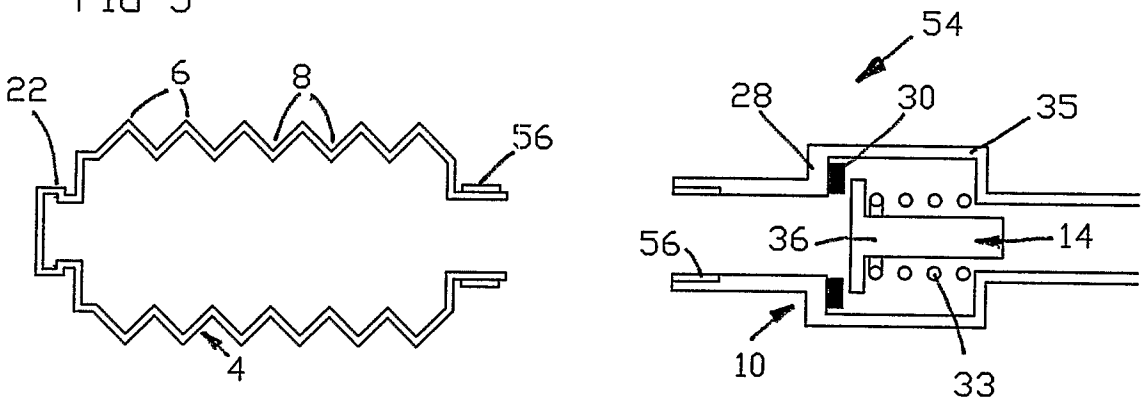
FIG. 6 is an exploded view of the apparatus shown in FIG. 5.

FIGS. 5 and 6 show apparatus 54 which is simpler than the apparatus 2 but in which many parts are the same. These parts are given the same reference numerals for ease of comparison and understanding. As can be seen from FIGS. 5 and 6, the apparatus 54 only has the one-way valve 14. This one-way valve 14 is removed from its seat against the seal 30 by fluid in the bellows 4 being forced into contact with the valve member 36 when the bellows 4 is squeezed. This is in contrast to the operation of the apparatus 2 where, in addition to the one-way valve 14, there is also the stem valve 12 which can be arranged, if desired, to push the valve member 36 off its seat against the seal 30. The connection of the bellows 4 to the valve housing 35 is by any suitable and appropriate connection means 56 on the housing 35 and a connection means 58 on the bellows 4.

Figure 7:
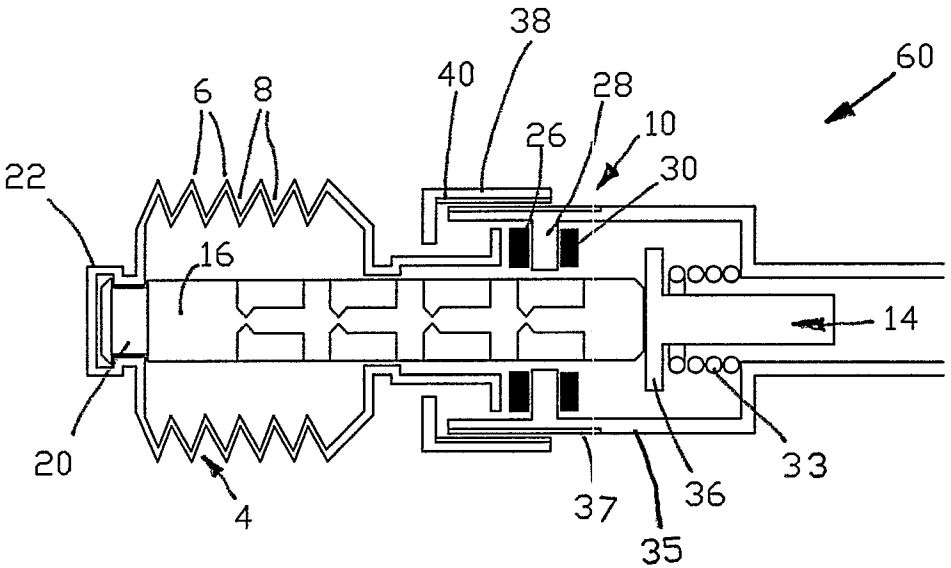
FIG. 7 shows third apparatus of the invention.
Figure 8:
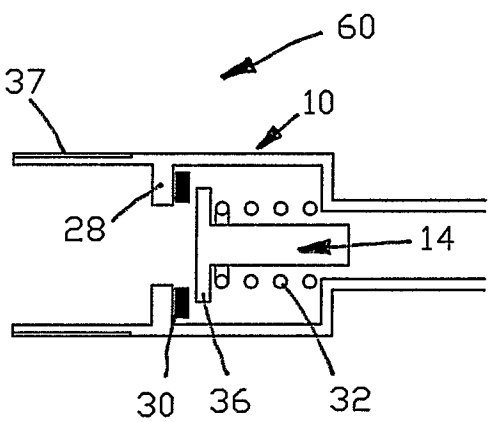
FIG. 8 is an exploded view of the apparatus shown in FIG. 7.
Figure 8:
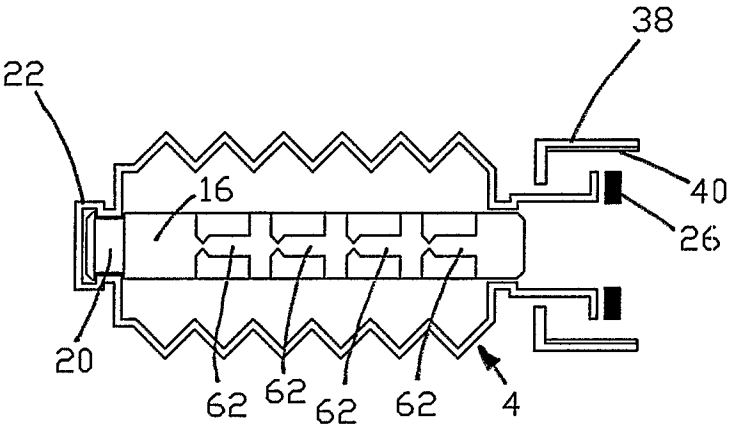

FIGS. 7 and 8 show third apparatus 60 which is similar to parts of the apparatus shown in previous Figures. Similar parts have been given the same reference numerals for ease of comparison and understanding. As can be seen from FIGS. 7 and 8, the valve stem 16 is provided in sections 62 as shown. The valve stem 16 is able to force the valve member 36 off its seat as shown in FIG. 7.

Figure 9:
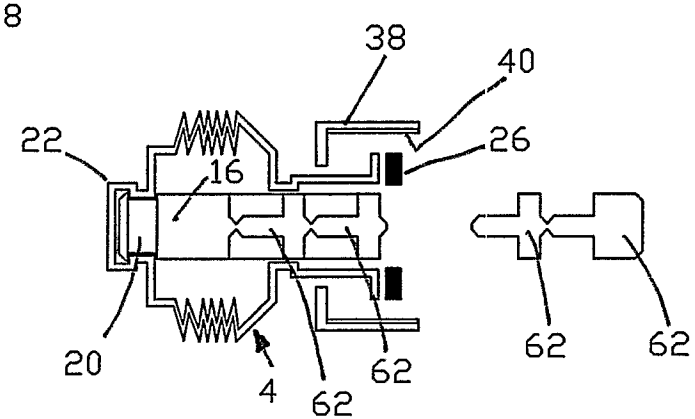
FIG. 9 shows how the apparatus of FIGS. 7 and 8 may be modified.

FIG. 9 shows part of the apparatus 60 shown in FIGS. 7 and 8, and illustrates how sections 62 of the valve stem 16 can be broken off if the valve stem 16 is too long.

Figures 10, 11, 12, 13, 14:
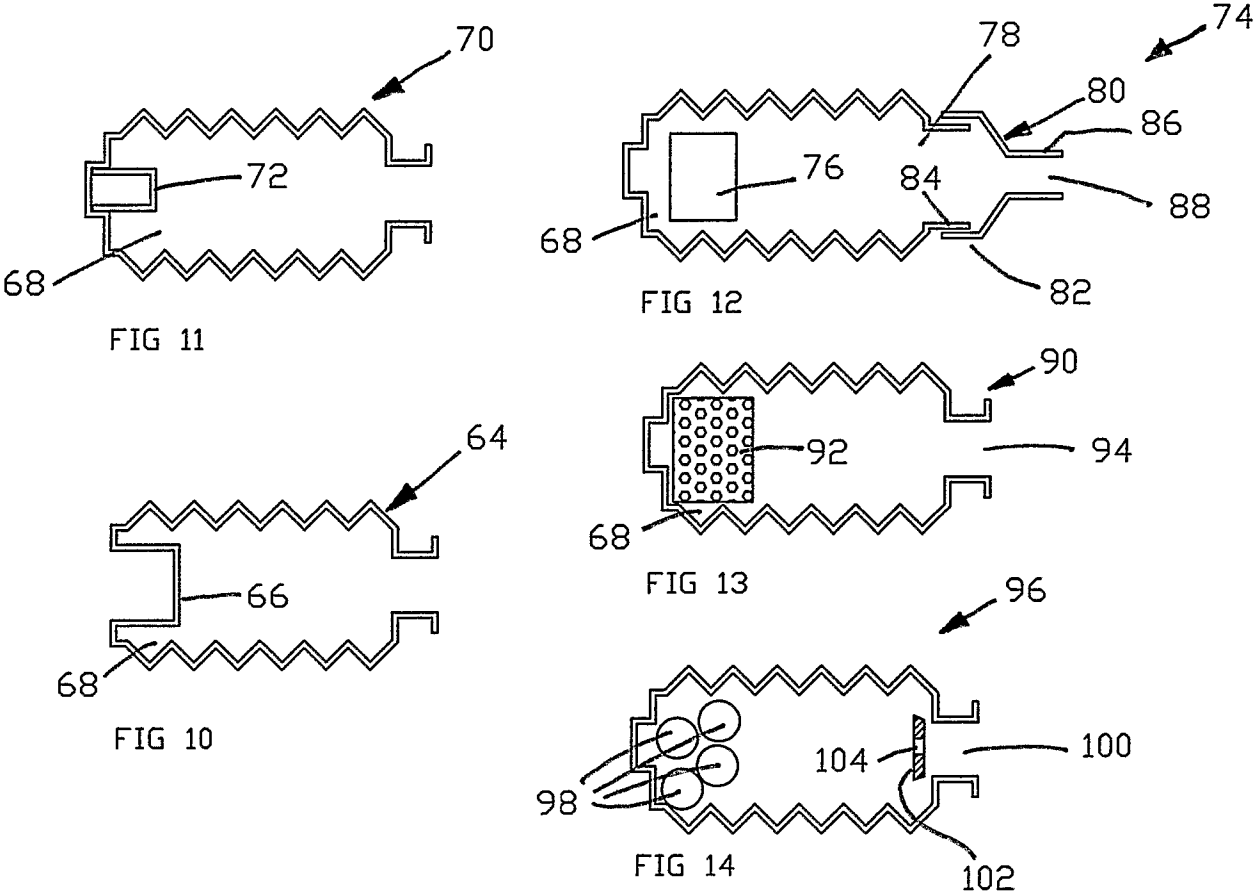
FIGS. 10-14 show different types of filler means for filling a part of the bellows from which fluid cannot easily be obtained during use of the apparatus of the invention.
Figure 15:
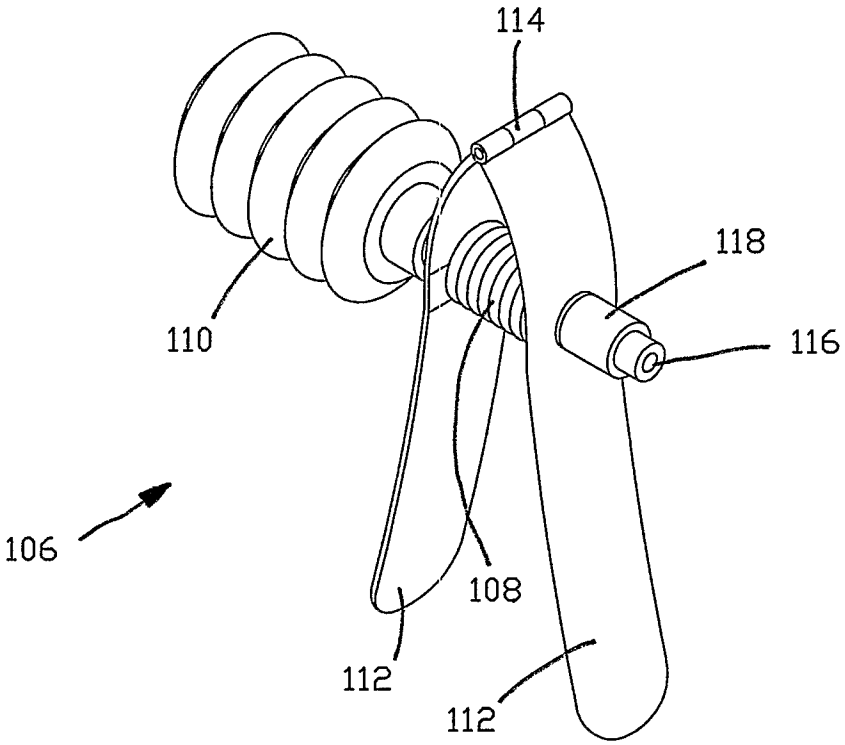
FIG. 15 is a perspective view of fourth apparatus of the present invention.

FIG. 10 shows a bellows 64 having filler means 66 for filing a part 68 of the bellows 64 from which fluid cannot be obtained during normal use of the apparatus 2. As can be seen from FIG. 10, the filler means 66 is a formation on the bellows 64. The formation extends inwardly of the bellows 64 and into the part 68.

FIG. 11 shows bellows 70 having filler means 72 for filing the part 68. The filler means 72 is in the form of a plug. As can be seen from FIGS. 10 and 11, the filler means 66 and 72 are both hollow.

FIG. 12 shows bellows 74 having filler means 76 for filing the part 68. The filler means 76 is a one-piece insert which is made of a non-compressible material. The bellows 74 is provided with an aperture 78 which is large enough to receive the filler means 76. The aperture 78 is then closed by a reducer device 80 which has a part 82 for going over a neck 84 defining the aperture 78. The reducer device 80 also has a neck 86 having an aperture 88 which is smaller than the aperture 78.

FIG. 13 shows bellows 90 having filler means 92. The filler means 92 is in the form of a one-piece insert which is made of a compressible material such for example as a sponge. The filler means 92 is thus able to be compressed to pass through the aperture 94. The filler means 92 can then expand and it can occupy the position shown in FIG. 13 to take up most of the space 68.

FIG. 14 shows bellows 96 provided with filler means in the form of a multi-piece insert formed of separate pieces 98. The separate pieces 98 are able to pass through an aperture 100 in the bellows 96. Retainer means in the form of a retainer disc 102 is employed in the aperture 100 to prevent the pieces 98 from escaping through the aperture 100. The retainer means 102 has an aperture 104 for allowing fluid to pass from the bellows 96, or into the bellows 96 as may be desired.

Examples of liquids that may be used in the present invention are hydraulic fluids, oils, aqueous solutions, and non-aqueous solutions. The liquids may be viscous liquids such for example as glue or caulk. The liquids may also be non-viscous liquids. Higher pressure systems which may have fluid injected into them, for example for top-up purposes and/or leak detection purposes include air conditioning systems and refrigeration systems. Generally the present invention may be used with a wide variety of pressurised fluid systems as are commonly used in industry. The air conditioning system may be for use in vehicles or the home. Where the fluid is for the purposes of detecting a leak, then this fluid may be arranged to be an easily noticeable liquid.

Where a plastics material is employed for the bellows, then this may be polypropylene. The polypropylene may be blow-moulded polypropylene. Where metals are employed, then these may be aluminium or copper. Where the bellows are made from a metal, then the number and shape of the convolutions may be varied to determine the degree of resilience of the bellows. This will in turn limit the degree with which the bellows can be squashed, and therefore the amount of fluid able to be ejected from or sucked into the bellows. Generally, if the bellows are made from a metal and the bellows are designed to collapse permanently, then fewer convolutions will be used and the shape of each convolution can be more open. Thus the build up of the total number of wall thicknesses is greatly reduced, enabling the bellows to be squeezed into a much shorter length and a corresponding greater amount of fluid dispensed. The bellows may be made by hydro-forming a tube or cup into the desired form.

Referring to FIGS. 10-14, other types of filler means may be employed. Thus, for example, the filler means may be an inflatable bag. If a foam such as the foam filler means 92 shown in FIG. 13 is employed, then the foam is preferably a closed-cell foam which is non-absorbent. Thus, the filler means 92 do not then absorb the fluid.

Referring now to FIGS. 15-18, there is shown apparatus 106 comprising a first bellows 108 and a second bellows 110. The first bellows 108 is smaller than the second bellows 110. The first bellows 108 is mounted between a pair of levers 112 which are pivotally connected together by a pivot hinge 114. Squeezing of the levers 114 together causes the first bellows 108 to be compressed. Fluid in the bellows 108 is then ejected from an outlet aperture 116 in an outlet fitting 118. The squeezing of the levers 112 enables the first bellows 108 to be squeezed with considerable force if this should be required, for example to overcome pressure of a sealed system into which fluid from the first bellows 108 is to be injected.

In the apparatus 106, the second bellows 110 is not squeezed. Fluid from the second bellows 110 is allowed to pass into the first bellows 108 as may be required. The smaller cross sectional area of the first bellows 108 may reduce the force needed to overcome the pressure of a system into which the fluid in the first bellows 108 is to be injected.

Figure 17:
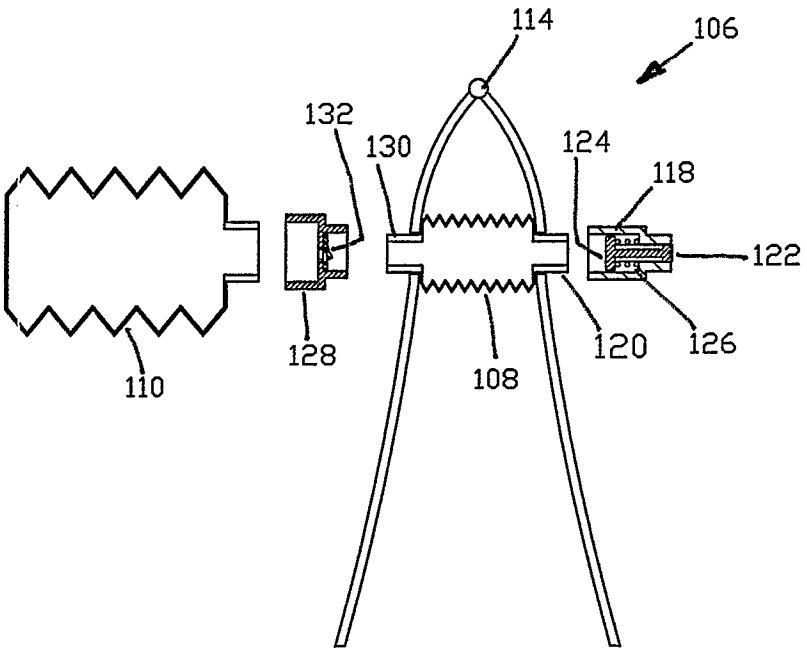
FIG. 17 is an exploded view of the apparatus as shown in FIG. 16.
Figure 16:
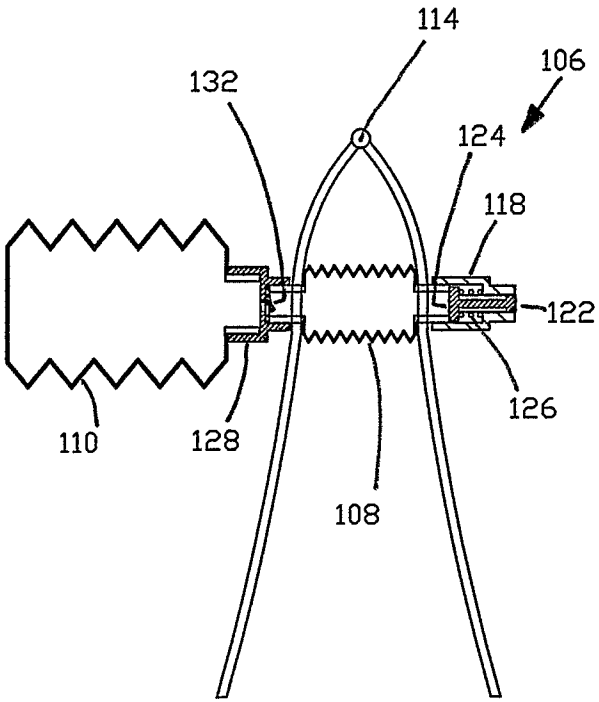
FIG. 16 is a side sectional view of the apparatus shown in FIG. 15.

As shown in FIG. 17, the outlet fitting 118 is able to be connected onto a stub pipe 120 forming part of the first bellows 108. The connection may be a screw-threaded connection or any other suitable and appropriate connection. The outlet fitting 118 comprises a valve means 122 having a valve head 124 which seals against the end of the stub pipe 120. The valve means 122 is biased to its closed position by a spring 126. When the first bellows 108 is squeezed, the fluid pressure from the first bellows 108 passing through the stub pipe 120 is sufficient to move the valve head 124 off its seat and thus allow the fluid to pass through the outlet fitting 118.

FIG. 17 also shows how the apparatus 108 is provided with an inlet fitting 128 which may be screw or otherwise connect onto a stub pipe 130 forming part of the bellows 108. The inlet fitting 128 has a flap valve 132 for permitting fluid from the second bellows 110 to pass through the inlet fitting 128, through the first bellows 108, and through the outlet fitting 118. Any suitable and appropriate type of liquid or gaseous fluid can be injected using the apparatus 108. The valve 122 forms a one way valve in the outlet fitting 118. The flap valve 132 forms a one way valve in the inlet fitting 128. The outlet fitting 118 is able to act as part of connector means for connecting the apparatus 106 to an external container or system. In this case, the outlet fitting 118 may connect to a first end of a conduit (not shown). A second end of the conduit may be provided with a connector for connecting to the external container or system.

Figure 18:
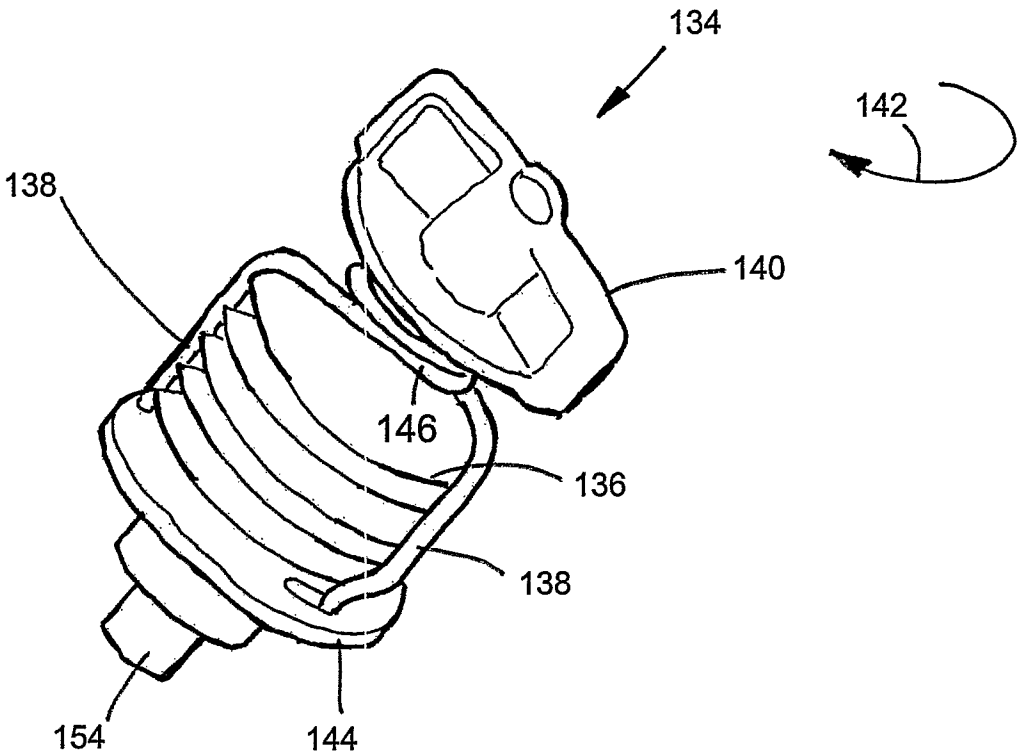
FIG. 18 is a perspective view of fifth apparatus of the present invention.
Figure 19:
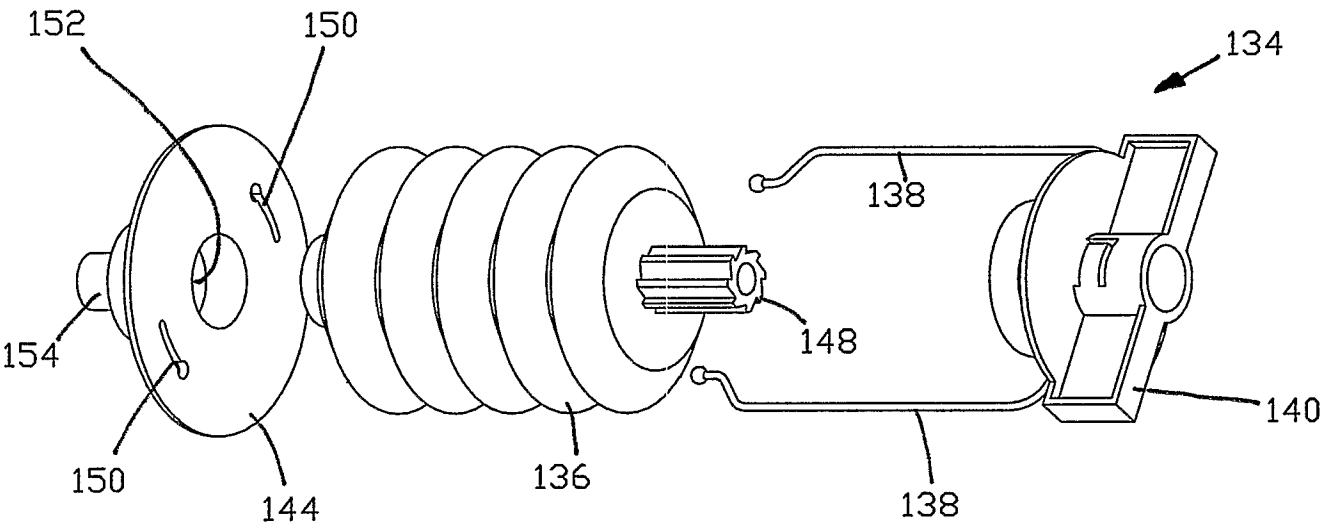
FIG. 19 is an exploded perspective view of the apparatus shown in FIG. 18.

Referring now to FIGS. 18 and 19, there is shown apparatus 134 comprising a bellows 136 and flexible straps 138. A handle 140 is able to be rotated as shown by the arrow 142. The straps 138 are connected to an end formation 144 of the bellows 136. Rotation of the handle 140 causes the straps 138 to wind around each other at position 146, and also to cause the bellows 136 to be squeezed together due to the effect of the straps 138 shortening in length and thus pulling the bellows 136 to its collapsed position. As shown in FIG. 19, the handle 140 fits on a ratchet device 148. The straps 138 fit in slots 150 in the end formation 144. The end formation 144 has an outlet aperture 152 in a stub outlet pipe 154. The stub outlet pipe 154 can form part of, or can be connected to, connector means for connecting the apparatus 134 to an external container or system.

The method of attaching the handle 140 as shown in FIG. 19 can be replaced by other methods. For example, an alternative method would be to incorporate a substantially round form on the back of the bellows, over which an appropriate tool could fit and rotate. The round form could have a number of ratchet teeth incorporated into its circumference, and the tool could have a cooperating tooth or teeth so that, when the tool was rotated, the tool would ratchet around the bellows 136. Such a tool would have the advantage of increasing mechanical strength for controlling the amount of compression or the reduction of the volume of the bellows 136, and hence the dispensed dose, for example to the external container or system.

As shown in FIG. 19, the winding tool in the form of the handle 140 and the straps 138 are a one piece moulding, the bellows 136 is a blow moulding with an integral pivot tube with the ratchet device 148, and the straps 138 are attached to the end formation 144 which is shown as a separate moulding. The separate moulding 144 could alternatively be part of the bellows 136.

Figure 20:
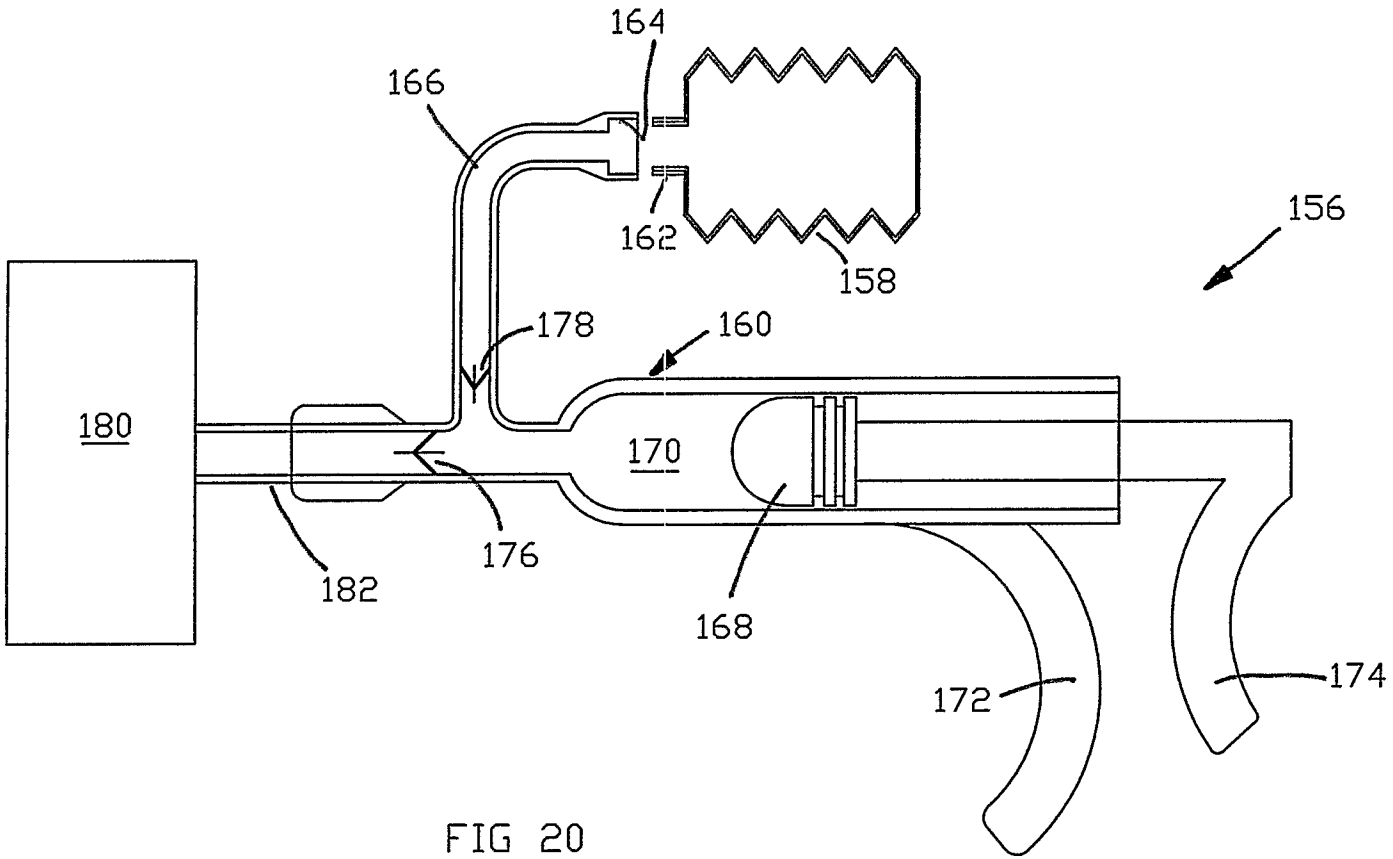
FIG. 20 is a sectional view of sixth apparatus of the present invention.

Referring now to FIG. 20, there is shown apparatus 156 comprising a collapsible bellows 158 which forms a collapsible cartridge. The bellows 158 is fitted to an injection device 160. Liquid is able to be drawn by suction from the bellows 158. The bellows 158 may be a pre-filled bellows 158.

The bellows 158, for example pre-filled, is fitted via a screw-threaded stub pipe 162 to an inlet 164 of a conduit 166. This fitting may take place whilst the piston 168 is fully depressed in a cylinder 170 by squeezing a pair of handles 172, 174 together. The apparatus 156 includes valve means in the form of one way valves 176, 178. The apparatus 2 is able to inject fluid from the bellows 158 into a pressurised system shown as a pressurised system 180. More specifically, when the spring loaded plunger formed by the handle 174 is released from its depressed position, the handle 174 and the piston 168 return to a back stop position. Liquid is drawn from the bellows 158 and into the cylinder 170. When the handle 174 is depressed again, the fluid in the cylinder 170 is displaced through the one way valve 176 and into the pressurised system 180. Connector means comprising a conduit 182 is used to link the apparatus 156 to the system 180. The one way valve 178 prevents the fluid feeding back through the conduit 168 and into the bellows 158. The apparatus 156 operates such that mechanical pressure is not applied to the bellows 158 so that there is negligible risk of the bellows 158 bursting during injection of fluids into high pressure systems 180. Any suitable and appropriate type of liquid and/or gas may be injected into the pressurised system 180 using the apparatus 156.

Referring now to FIGS. 21-25, there is shown apparatus 184 comprising bellows 186 located in a housing 188. The housing 188 is connected to a ring member 190. The housing 188 connects to the ring member 190 with a bayonet thread arrangement 192, but it may alternatively connect with any suitable and appropriate connection arrangement such for example as a continuous screw-threaded arrangement. The connection is ideally such that the housing 188 is able quickly and easily to be connected to and released from the ring member 190. This enables a housing 188 with an empty used bellows 186 quickly and easily to be removed from the ring member 190 and a new housing 188 with a full unused bellows 186 to be inserted into the ring member 190.

The side of the ring member 190 remote from the bellows 186 is provided with a stub portion 194. The stub portion 194 is provided with internal threads 196 to receive external threads 198 on a plunger 200. The plunger 200 has a handle 202 which enables the plunger 200 to be screwed through the ring member 190.

The plunger 200 has a head portion 204. As the plunger 200 is screwed through the ring member 190, the head portion 204 presses on an end 206 of the bellows 186. Screwing of the plunger 200 through the ring member 190 causes the bellows 186 to become compressed. Fluid in the bellows 186 is thus forced out of the bellows 186 and through an ejector valve 208. The head portion 204 is rotatably connected to a stem part 210 of the plunger 200 by a rotatable connection 212. This rotatable connection 212 enables the plunger 200 and its stem part 210 to be rotated through the ring member 190 without the head portion 204 rotating. This means that there is no relative rotational movement between the head portion 204 and the end 206 of the bellows 186, and thus this avoids unnecessary rotational wear on the end 206 of the bellows 186.

Figures 21, 22, 23:
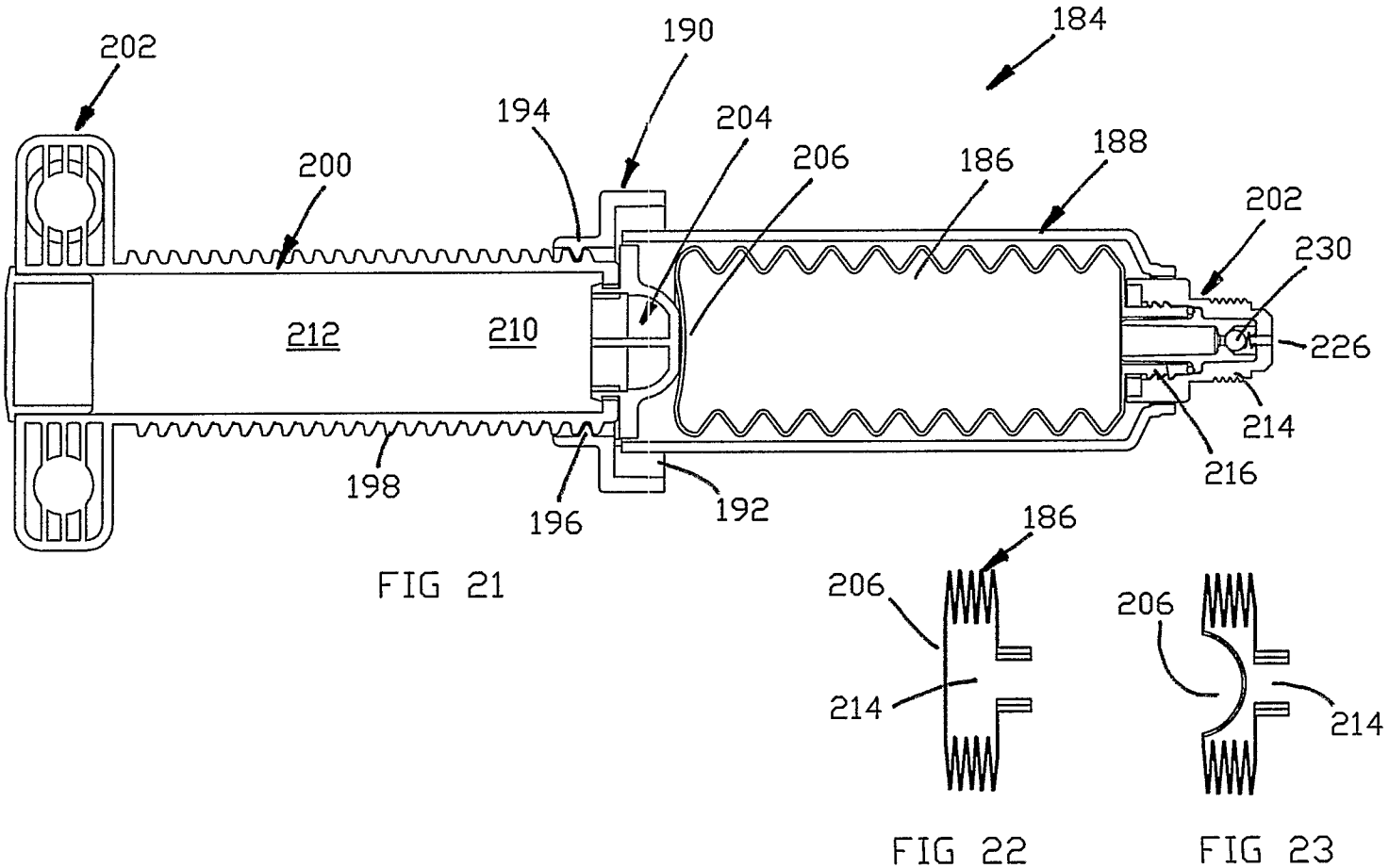
FIG. 21 is a sectional view of seventh apparatus of the present invention.
FIG. 22 shows how a compressed bellows of the apparatus shown in FIG. 21 could have a part from which fluid cannot be obtained during use of the apparatus.
FIG. 23 shows how the apparatus of FIG. 21 enables fluid to be obtained from the part of the bellows shown in FIG. 22.

Referring to FIG. 22, there is shown the bellows 186 in a collapsed condition as would be caused by screwing the plunger 200 completely through the ring member 190, but without the head portion 204. It will be seen that there is a space 214 from which fluid in the bellows 186 cannot be squeezed out. As shown in FIG. 23, by using the head portion 204, the end 206 of the bellows 186 becomes concave and extends into the space 214, thereby substantially reducing the size of the space 214 and the amount of the fluid in the space 214 that is not able to be squeezed out of the bellows 186.

Figure 24:
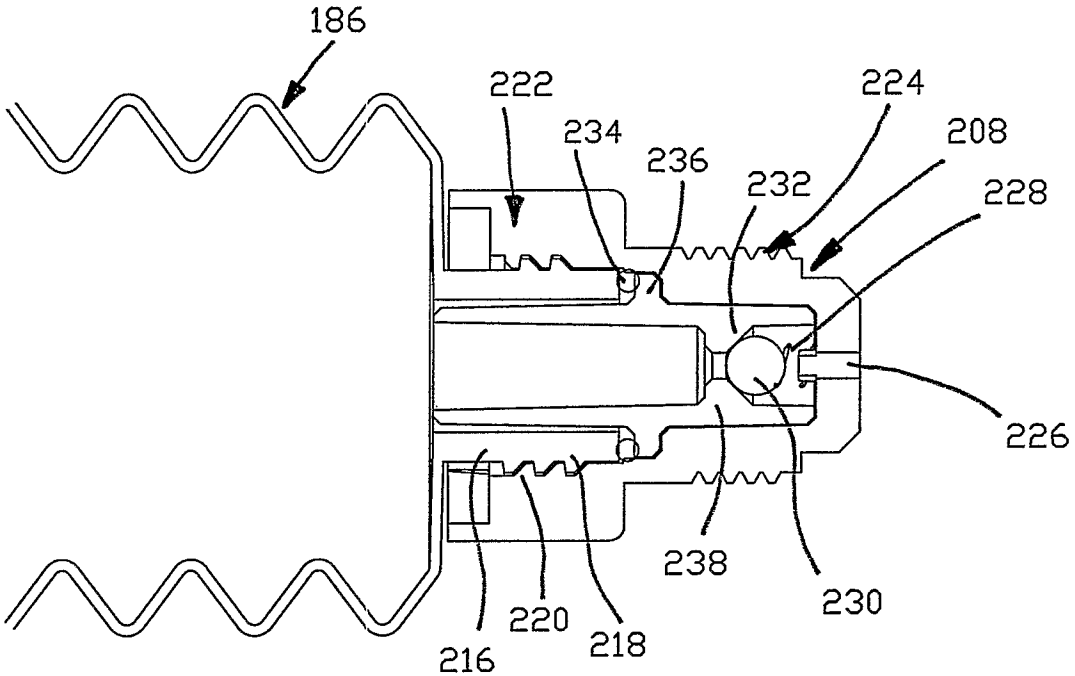
FIG. 24 is an enlarged sectional view of the right hand end of the apparatus shown in FIG. 21.
Figure 25:
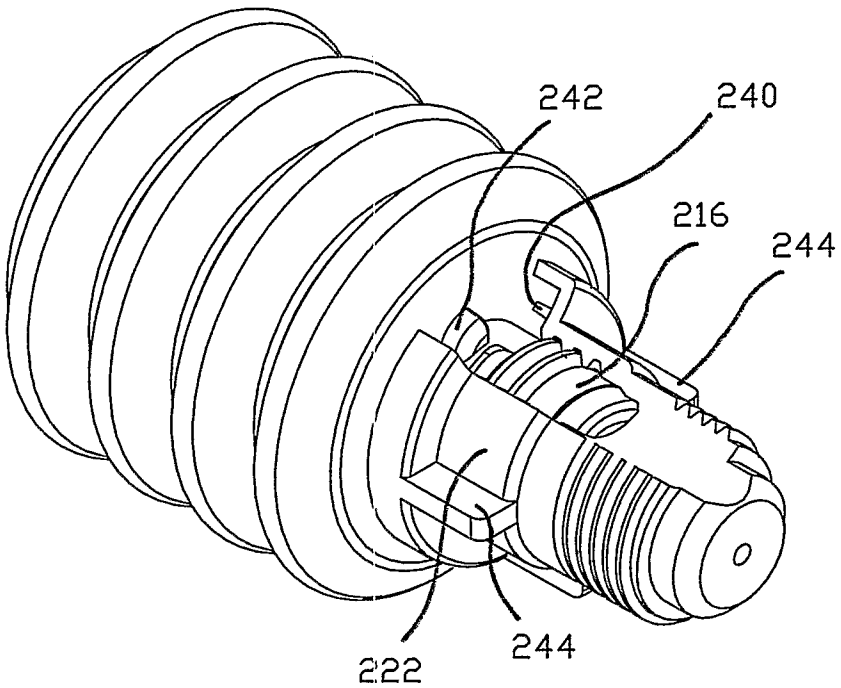
FIG. 25 is a perspective view, partially cut-away, of the apparatus as shown in FIG. 24.

As can best be appreciated from FIGS. 24 and 25, the bellows 186 has a forward stub portion 216. This stub portion 216 is provided with external threads 218 for receiving internal threads 220 on valve means including a valve body 222. The valve body 222 is thus able to be screwed to the stub portion 216 of the bellows 186.

The valve body 222 terminates in a threaded portion 224 which is able to form part of connector means for connecting the apparatus to an external container or a system. Thus the threaded portion 224 may connect to one end of a pipe (not shown), and the other end of the pipe may connect to the external container or system.

The threaded portion 224 has an outlet aperture 226. A spring 228 presses a ball 230 against a valve seat 232. An O-ring seal 234 ensures a fluid tight seal between the end of the stub portion 216 and a flange 236 on an inner body part 238 of the valve 208.

During operation of the apparatus 184, the plunger 200 is screwed through the ring member 190 in order to compress the bellows 186 and force fluid from the bellows 186 through the vale 208. The force of the fluid forces the ball 230 off its seat 232 and thus fluid is allow to pass through the outlet aperture 226 and into the container or system requiring the fluid. In order for this to happen, the pressure exerted on the bellows 186 has to be greater than the pressure inside the container or system. When the injection pressure applied to the bellows 186 is less than the pressure in the container or system, then the ball 230 is forced by the pressure of the container or system and by the spring 228 against the valve seat 232. This prevents the fluid from the container or system passing into the bellows 186. The spring 228, the ball 230 and the valve seat 232 thus act as a failsafe valve system which helps to prevent excessive pressure build up within the bellows 186 if too much fluid from the container or system were allowed to pass back into the bellows 186. If for example, the bellows 186 were to fail, the pressure in the bellows 186 would immediately drop below the pressure in the container or system, and in this case the ball valve 232 would be returned to its seat 232 and would prevent the escape of fluid from the container or system. When the apparatus 184 is not connected to a container or system, then the ball 230 is still forced against its seat 232, but this time solely by the spring 228. Thus the spring 228 ensures that the bellows 186 is sealed and that fluid from the bellows 186 does not leak out during handling and transport.

The inner body part 238 is a press-fit within the valve body 222. Other connection means may be employed. As can best be seen from FIG. 25, the valve body has legs 240 which drop over teeth 242 as the valve body 222 is screwed over the stub portion 216. The legs 240 abut against the teeth 242 and prevent easy removal of the valve body 222 from the stub portion 216. Screwing of the valve body 222 over the stub portion 216 is facilitated by wings 244 which form hand holds.

Figure 26:
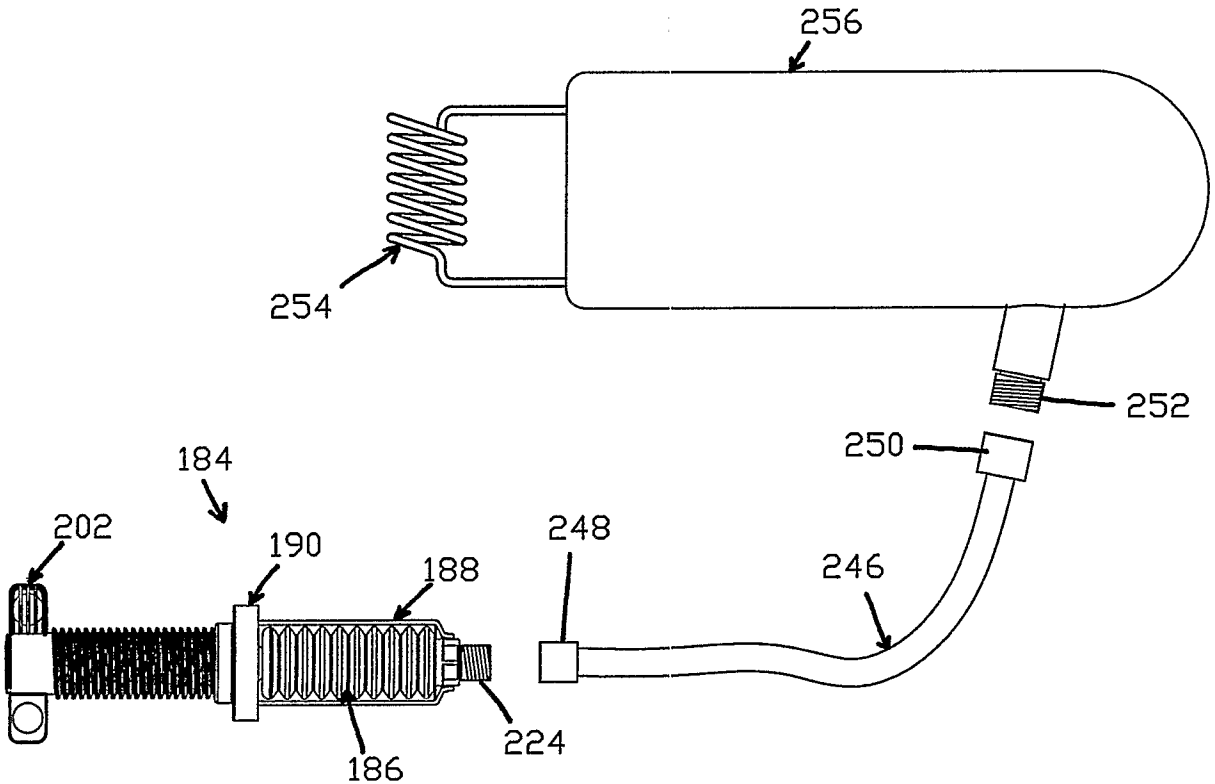
FIG. 26 illustrates how apparatus for causing fluid flow is able to be connected to an external system.

Referring now to FIG. 26, there is shown how the apparatus 184 shown in FIG. 21 is able to be connected to a pipe 246 via the threaded portion 224 on the apparatus 184 and a threaded portion 248 on a first end of the pipe 246. The other end of the pipe 246 has a threaded portion 250 for screwing to a threaded portion 252 on a pressurised system 254 in a product 256. The pressurised system 254 may be any suitable and appropriate pressurised system and the product 256 may be any suitable and appropriate product. Thus, for example, the pressurised system may be an air conditioning system in a motor vehicle, a refrigeration system in premises, or a hydraulic system in a fork lift truck. The apparatus 184 may be any other apparatus of the present invention.

In the present invention, the use of the bellows may be advantageous over more complicated piston and cylinder arrangements. With appropriate valves such for example as the illustrated stem valves, the bellows may enable the injection of controlled doses of a desired fluid. Thus, for example, reducing the length of the valve stem 16 as shown in FIG. 9 may give correspondingly less amounts of material injected from the apparatus. The various sections of the valve stem 16 may be snapped off, cut off or otherwise removed as may be desired.

It is to be appreciated that the embodiments of the invention described above with reference to the accompanying drawings have been given by way of example only and that modifications may be effected. Thus, for example, the bellows may be of different shapes to those shown. The head portion 204 may also be a different shape to that shown. More than one bellows, for example two bellows, may be employed in line. Various valve arrangements may be employed to stop air being sucked back into the apparatus when it is desired simply to eject a fluid such for example as a liquid into a pressurised system. Where the bellows are compressed by the application of pressure, the compression may alternatively be effected by the application of a vacuum.

The invention claimed is:

1. Apparatus for introducing a liquid into a sealed external container or a sealed external system, wherein the apparatus comprises a bellows which is sealed at a first end, which is sealed at a second end solely by a valve, and which contains the liquid; wherein the valve is one which is positioned remote from the first end of the bellows, which retains the liquid in the bellows, and which permits liquid flow only in a direction from the apparatus to the sealed external container or the sealed external system; wherein said apparatus further comprises a connector which in use forms a sealed connection between the apparatus and a sealing valve on the sealed external container or the sealed external system; wherein the bellows contains the liquid prior to connection to the sealed external container or the sealed external system; and wherein the sealed external container or the sealed external system is constructed to be operable independently of the bellows.

2. Apparatus according to claim 1 in which the bellows is made of a metal or a plastics material.

3. Apparatus according to claim 1 in which the bellows has side walls which in longitudinal section have a wave form which has curved peaks and troughs, or pointed peaks and troughs.

4. Apparatus according to claim 1 in which the valve is operated by movement of the bellows.

5. Apparatus according to claim 1 in which the valve is a stem valve which is partially positioned in the bellows.

6. Apparatus according to claim 1 in which the valve is positioned remote from the bellows.

7. Apparatus according to claim 1 in which the valve is a spring biased valve which is biased by a spring.

8. Apparatus according to claim 1 in which the valve is separate from the bellows and is operated independently of the bellows.

9. Apparatus according to claim 1 in which the connector comprises a conduit having a first end which is connected to a remainder of the apparatus, and a second end which is provided with a device for connecting to the sealed external container or the sealed external system.

10. Apparatus according to claim 9 in which the device at the second end of the conduit is a screw connector.

11. Apparatus according to claim 9 in which the first end of the conduit is connected to the remainder of the apparatus by a screw connector.

12. Apparatus according to claim 1 in which the bellows includes an aperture through which the liquid flows.

13. Apparatus according to claim 1 and including a filler for filling a part of the bellows from which the liquid cannot be obtained during use of the apparatus.

14. Apparatus according to claim 13 in which the filler is a formation which extends inwardly of the bellows and into the part of the bellows from which the liquid cannot be obtained during use of the apparatus.

15. Apparatus according to claim 14 in which the formation is a hollow formation.

16. Apparatus according to claim 14 in which the filler is an insert in an inside of the bellows.

17. Apparatus according to claim 16 in which the insert is a plug which is secured in position to the inside of the bellows, or in which the insert is a one-piece insert.

18. Apparatus according to claim 12 in which:

there is a one-piece insert;

the one-piece insert is a non-compressible one-piece insert, the aperture in the bellows is large enough to receive the one-piece insert, and the aperture is reduced in size by a reducer device having a smaller aperture than the aperture in the bellows;

or the one-piece insert is a compressible insert which is able to be compressed to pass through the aperture in the bellows and which then expands to stay inside the bellows.

19. Apparatus according to claim 16 in which the inset is a multi-piece insert formed of separate pieces.

20. Apparatus according to claim 19 and including a retainer for retaining the separate pieces of the multi-piece insert in the bellows.

21. Apparatus according to claim 1 in which the valve is positioned on the second end of the bellows.

* * * * *